US008454061B2

(12) United States Patent
Spurr

(10) Patent No.: US 8,454,061 B2
(45) Date of Patent: Jun. 4, 2013

(54) LATCH SYSTEM

(75) Inventor: Nigel V. Spurr, Solihull (GB)

(73) Assignee: Inteva Products USA, LLC, Troy, MI (US)

( * ) Notice: Subject to any disclaimer, the term of this patent is extended or adjusted under 35 U.S.C. 154(b) by 1110 days.

(21) Appl. No.: 12/134,427

(22) Filed: Jun. 6, 2008

(65) Prior Publication Data

US 2008/0303291 A1 Dec. 11, 2008

(30) Foreign Application Priority Data

Jun. 8, 2007 (GB) ..... 0711027.3

(51) Int. Cl.
*E05C 3/06* (2006.01)

(52) U.S. Cl.
USPC ..... 292/216; 292/201; 292/DIG. 23

(58) Field of Classification Search
USPC ..... 292/216, 201, DIG. 23
See application file for complete search history.

(56) References Cited

U.S. PATENT DOCUMENTS 5,765,884 A * 6/1998 Armbruster ..... 292/216
7,070,212 B2 * 7/2006 Spurr ..... 292/216

FOREIGN PATENT DOCUMENTS

| | | |
|---|---|---|
| EP | 1217153 | 6/2002 |
| EP | 1217155 | 6/2002 |
| EP | 1783307 | 5/2007 |
| WO | 2006/087578 | 8/2006 |

OTHER PUBLICATIONS

United Kingdom Search Report dated Sep. 21, 2007.

* cited by examiner

*Primary Examiner* — Kristina Fulton
(74) *Attorney, Agent, or Firm* — Cantor Colburn LLP

(57) ABSTRACT

A latch system includes a latch bolt, a pawl for releasably retaining the latch bolt in a closed position, a first release member, a first transmission path connecting the first release member to the pawl, a second release member, and a second transmission path connecting the second release member to the pawl. A portion of the first transmission path and a portion of the second transmission path have a common portion, the common portion including a lock link having a first position at which the lock link completes the first transmission path and the second transmission path such that operation of either the first release member or the second release member opens a latch, and the lock link having a second position at which the lock link breaks the first transmission path and the second transmission path such that a single operation of either the first release member or the second release member does not open the latch. The latch system includes a first device capable of holding the lock link in the second position, a second device capable of holding the lock link in the second position, and a third device capable of holding the lock link in the second position.

18 Claims, 14 Drawing Sheets

LATCH SYSTEM

REFERENCE TO RELATED APPLICATIONS

This application claims priority to United Kingdom Patent Application No. GB 0711027.3 filed on Jun. 8, 2007.

BACKGROUND OF THE INVENTION

The present invention relates to a latch system, in a particular a latch system for a vehicle door, such as a car door.

European patent application no. EP 01310100 shows a known latch arrangement (see FIG. 20 of the present case). The latch arrangement includes a latch chassis 1 on which is rotatably mounted a lever 2 which operates a link 3, which in turn moves a pin 4 to release the latch. Movement of the link 3 is controlled by a lever 5 and a link 6. The position of the lever 5 is controlled either by an electromagnet 7 or by a permanent magnet 8. Springs 9A and 9B control the position of various components during operation.

One of the embodiments shown in European patent application no. EP 01310124 shows a similar arrangement.

In both cases, the lever 5 can be prevented from moving in one of two ways: either by powering the electromagnet 7 or by positioning an end of the permanent magnet 8 underneath an end of the lever 5. When the electromagnet 7 is powered, it consumes power, and therefore the electromagnet 7 is typically only used to lock the vehicle when the associated engine is running and hence the vehicle's battery is not discharged.

When the permanent magnet 8 is used to hold the position of the lever 5, a key is required to disengage the permanent magnet 8 from the lever 5, or alternatively the electromagnet 7 can be momentarily powered so as to move the permanent magnet 8 by virtue of a magnetic field generated by the electromagnet 7. Typically, the permanent magnet 8 is used to lock the vehicle when the driver is absent from the vehicle.

However, there are occasions when a driver or other vehicle occupant may wish to remain in the vehicle (perhaps while taking a rest on a long journey), but nevertheless have the vehicle doors locked. Under these circumstances, the vehicle engine will not be running and hence locking the vehicle using the electromagnet 7 would potentially drain the vehicle's battery. On the other hand, if the vehicle is locked by using the permanent magnet 8 and then an electrical failure occurred, it is not possible to unlock the vehicle using the electromagnet 7 to move the permanent magnet 8. Using a key to move the permanent magnet 8 would be awkward for an occupant of the vehicle since the key hole would be on the outside of the vehicle.

SUMMARY OF THE INVENTION

The present invention provides a system whereby an occupant of a vehicle can lock the door latches of the vehicle while remaining in the vehicle while the vehicle engine is turned off, but can readily open the door when required.

Thus, according to the present invention, there is provided a latch system including a latch bolt, a pawl for releasably retaining the latch bolt in a closed position, a first release member, a first transmission path connecting the first release member to the pawl, a second release member, and a second transmission path connecting the second release member to the pawl. A portion of the first transmission path and a portion of the second transmission path have a common portion, the common portion including a lock link having a first position at which the lock link completes the first transmission path and the second transmission path such that operation of either the first release member or the second release member opens the latch, and the lock link having a second position at which the lock link breaks the first transmission path and the second transmission path such that a single operation of either the first release member or the second release member does not open the latch. The latch system includes a first device capable of holding the lock link in the second position, a second device capable of holding the lock link in the second position, and a third device capable of holding the lock link in the second position.

As can be seen from FIG. 20, European patent application EP01310100 requires two springs 9A and 9B to control the various components of the system. There is a cost associated with providing each spring, providing the features to attach each spring 9A and 9B to an associated component, and the actual fitting of each spring 9A and 9B.

The present invention provides a latch system which is less expensive to manufacture and produce.

Thus, according to another object of the present invention, there is provided a latch system including a latch bolt, a pawl for releasably retaining the latch bolt in a closed position, a first release member, a first transmission path connecting the first release member to the pawl, a second release member, and a second transmission path connecting the second release member to the pawl. A portion of the first transmission path and a portion of the second transmission path have a common portion, the common portion including a lock link having a first position at which the lock link completes the first transmission path and the second transmission path such that operation of either the first release member or the second release member opens the latch, and the lock link having a second position at which the lock link breaks the first transmission path and the second transmission path such that a single operation of either the first release member or the second release member does not open the latch. The latch system includes a device capable of holding the lock link in the second position, wherein the lock link is moveable between the first position and the second position by a first control member. The first control member is moveable by a second control member, and the device acts on the second control member to hold the lock link in the second position. The latch system also includes a resilient device that acts to bias the lock link to the first position.

Certain prior art door latches include a latch opening motor which can be powered to open the latch. The same prior art latches also include a second motor which provides security functions, such as locking and unlocking. Providing two motors in the same latch is expensive.

The present invention provides a latch system which is less expensive to manufacture and produce.

Thus, according to another object of the present invention, there is provided a latch system including a latch bolt, a pawl for releasably retaining the latch bolt in a closed position, a first release member, a first transmission path connecting the first release member to the pawl, a second release member, and a second transmission path connecting the second release member to the pawl. A portion of the first transmission path and a portion of the second transmission path have a common portion, the common portion including a lock link having a first position at which the lock link completes the first transmission path and the second transmission path such that operation of either the first release member or the second release member opens the latch, and the lock link having a second position at which the lock link breaks the first transmission path and the second transmission path such that a single operation of either the first release member or the second release member does not open the latch. The latch system includes a device capable of holding the lock link in the second position, and a motor operable to unlatch the latch. During power opening of the latch, the motor causes the device to free the lock link for movement to the first position, and the motor is capable of moving the device to a position such that the lock link is retained in the second position.

BRIEF DESCRIPTION OF THE DRAWINGS

The invention will now be described, by way of example only with reference to the accompanying figures, in which.

DETAILED DESCRIPTION OF THE PREFERRED EMBODIMENT

Figure 1:
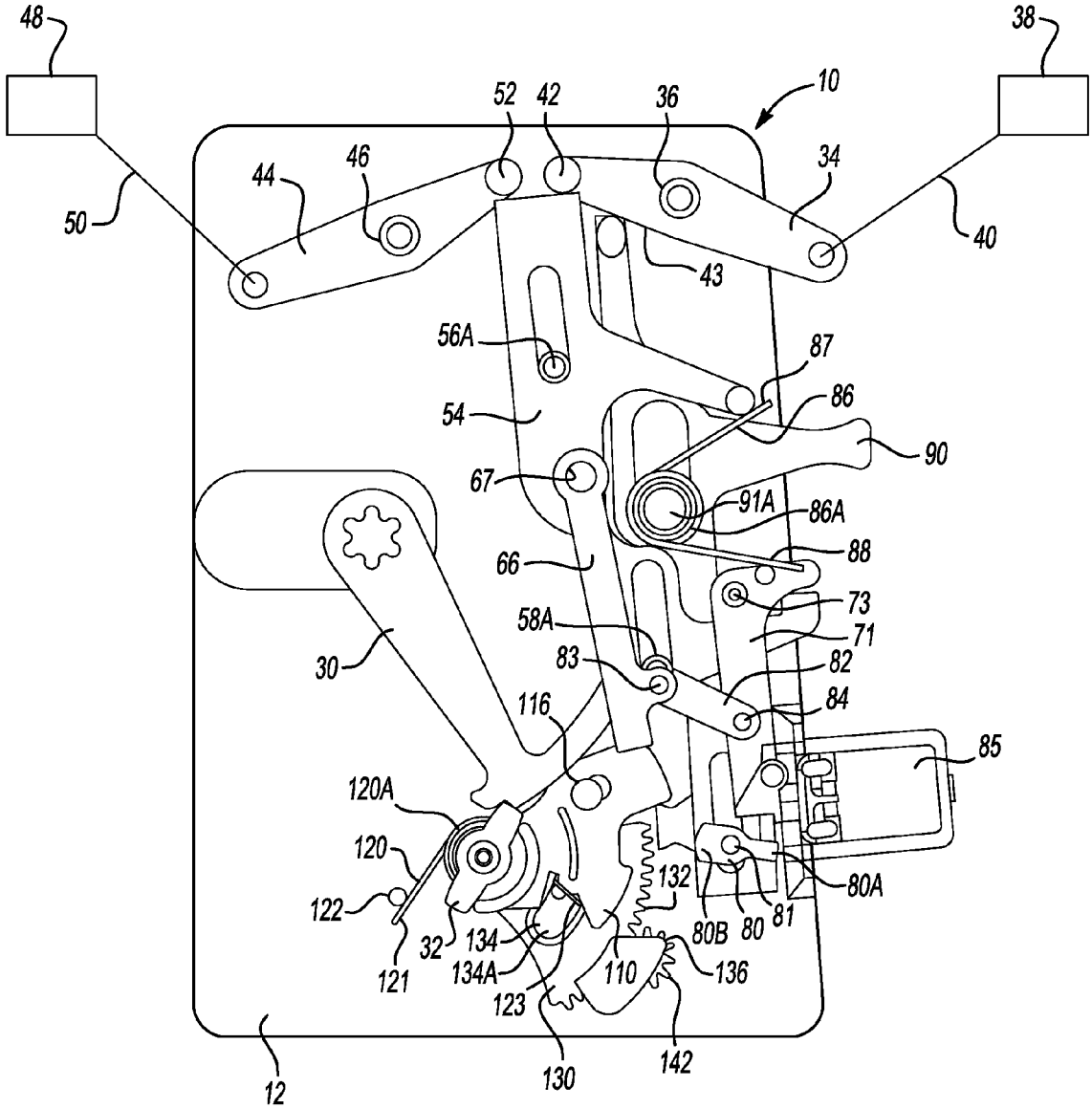
FIG. 1 shows a latch system according to the present invention.
Figure 2:
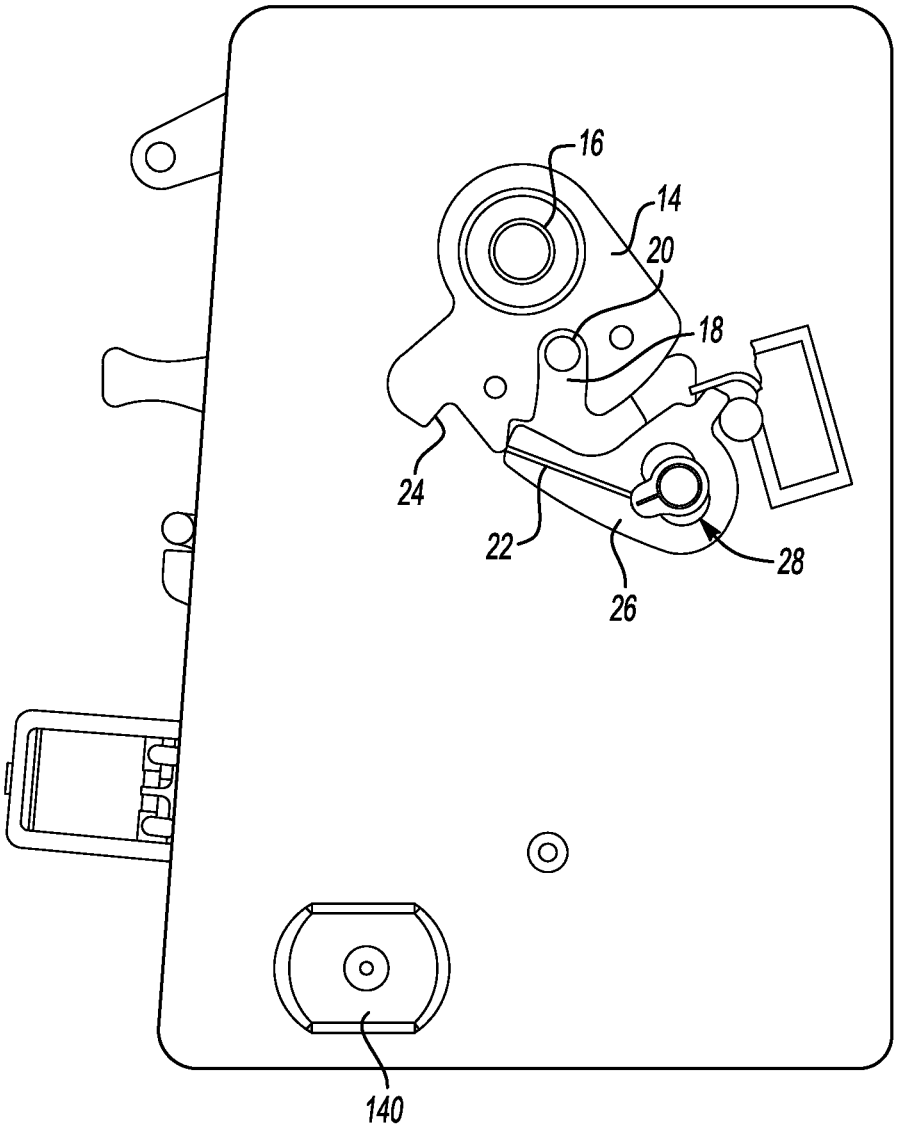
FIG. 2 shows a view of the latch system of FIG. 1 taken from a reverse direction.

With reference to FIG. 1, there is shown a latch 10 having a latch chassis 12 upon which various components of the latch 10 are mounted. A latch bolt in the form of a rotating claw 14 is pivotally mounted about a pivot pin 16 on the latch chassis 12, as shown in FIG. 2. The rotating claw 14 includes a mouth 18 for releasably retaining a striker 20. The claw 14 includes a closed abutment 22 and a first safety abutment 24. A pawl 26 engages the closed abutment 22 to hold the claw 14 in a closed position. Alternatively, the pawl 26 can engage the first safety abutment 24 to hold the claw 14 in a first safety position. In this position, while the latch 10 is not fully closed, nevertheless the door will not open. By disengaging the pawl 26 from the claw 14, the claw 14 is free to rotate to an open position, thereby releasing the striker 20 and allowing the associated door (typically attached to the latch) to open. The pawl 26 is mounted on an eccentric arrangement 28, details of which can be found in the Applicant's copending international patent application PCT/GB2006/000586. However, in summary, the pawl 26 is held in the position shown in FIG. 2 when a pawl release lever 30 is held in the position shown in FIG. 1 by a secondary pawl 32. Rotation of the secondary pawl 32 in a clockwise direction (as will be described below) releases the pawl release lever 30, which then rotates in a clockwise direction as shown in FIG. 1 as a result of forces acting between the claw 14 and the pawl 26. This allows the pawl 26 to disengage from the closed abutment 22 and allow the claw 14 to rotate counter-clockwise (when viewing FIG. 2) to the open position.

The latch 10 further includes an inside release lever 34 (also referred to as a first release member) pivotally mounted on the pivot pin 36 to the latch chassis 12. The inside release lever 34 is connected to an inside door handle 38 (shown schematically) by a connection 40 (shown schematically). The other end of the inside release lever 34 includes an abutment 42. An outside release lever 44 (also referred to as a second release member) is pivotally connected to the latch chassis 12 via a pivot pin 46. One end of the outside release lever 44 is connected to an outside door handle 48 (shown schematically) via a connection 50 (shown schematically). The other end of the outside release lever 44 includes an abutment 52.

Figure 11:
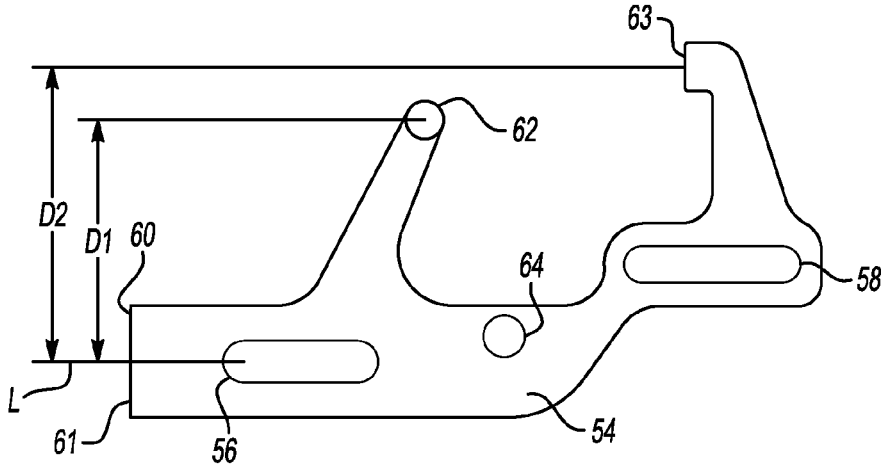
FIG. 11 to 15 show components of the latch system of FIG. 1 in isolation.

A release shuttle 54 includes two slots 56 and 58. In this case, the slots 56 and 58 are generally parallel, though in further embodiments this need not be the case. Positioned within the slot 56 is a guide pin 56A, and positioned within the slot 58 is a guide pin 58A. The guide pins 56A and 58A are mounted on the latch chassis 12. The arrangement of the slots 56 and 58 and the guide pins 56A and 56B allows the release shuttle 54 to be moved linearly relative to the latch chassis 12, as will be further described below. The release shuttle 54 includes abutments 60, 61, 62 and 63 (see FIG. 11). The release shuttle 54 further includes a pin 64.

Figure 12:
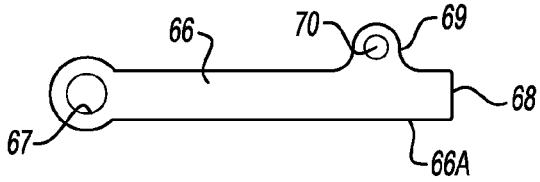

A lock link 66 is generally elongate and includes a hole 67 (see FIG. 12) at one end to enable the lock link 66 to be mounted on the pin 64 of the release shuttle 54. An opposite end of the lock link 66 includes an abutment 68. A side lug 69 includes a hole 70.

Figure 13:
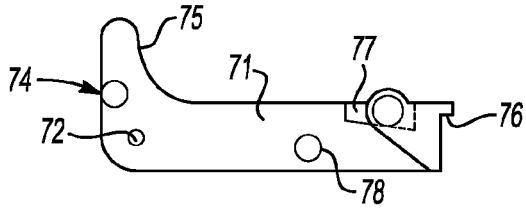

An interlock lever 71 (see FIG. 13) is pivotally mounted on the latch chassis 12 via a hole 72 and a pivot pin 73. The interlock lever 71 includes abutments 74 and 75. A ledge 76 acts as an abutment for a permanent magnet 80 and a lock shuttle 90, as will be described below. The interlock lever 71 is generally manufactured from a non-magnetic material, such as plastic. A magnetic piece 77 is mounted in the interlock lever 71.

The permanent magnet 80 (see FIG. 1) is pivotally mounted on the latch chassis 12 via a pivot pin 81.

One end of an interlock link 82 (see FIG. 1) includes a pin 83 upon which the hole 70 of the lock link 66 is mounted. The interlock link 82 includes a hole 84 at an opposite end from the pin 83 within which sits the pin 78 of the interlock lever 71. The interlock link 82 connects the lock link 66 with the interlock lever 71.

An electromagnet 85 is mounted on the latch chassis 12.

Figure 14:
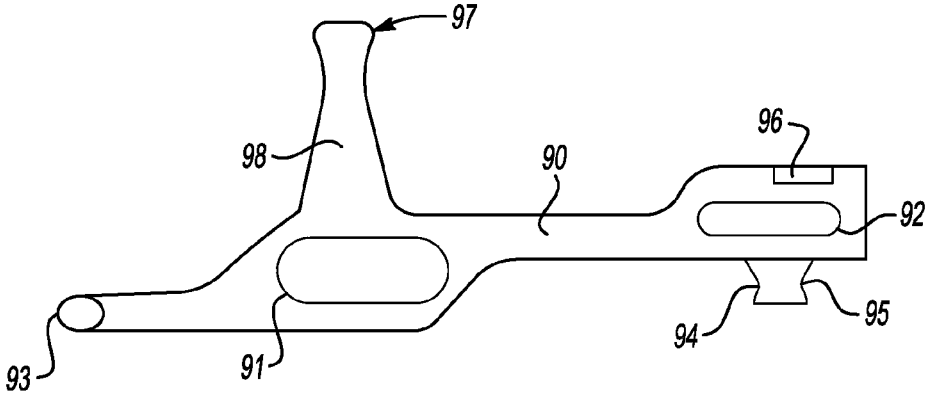

The lock shuttle 90 (see FIG. 14) includes slots 91 and 92. A guide pin 91A is positioned within the slot 91. A portion of the pivot pin 81 is positioned within the slot 92. In this case, the slots 91 and 92 are generally parallel, though in further embodiments this may not be the case. The guide pin 91A and the portion of the pivot pin 81 allow the lock shuttle 90 to move linearly, as will be further described below. The lock shuttle 90 includes abutments 93, 94 and 95. An abutment 96 projects out of the general plane of the lock shuttle 90 (i.e., towards the viewer when viewing FIG. 14). An abutment 96 engages part of a ledge 76, as will be further described below. The lock shuttle 90 further includes a manually actuable portion 97 at an end of an arm 98.

A torsion spring 86 (see FIG. 1) includes a helically wound portion 86A mounted on the guide pin 91A, an arm 87 which engages the abutment 62 of the release shuttle 54, and an arm 88 which engages the abutment 74 of the interlock lever 71.

Figure 15:
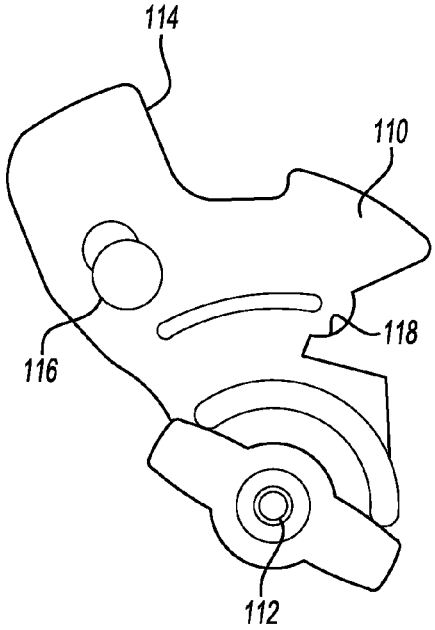

A release sector 110 (see FIG. 15) is rotationally fast with the secondary pawl 32, and both are capable of rotating about a pivot pin 112. The release sector 110 includes an abutment 114, 116 and 118. A torsion spring 120 (see FIG. 1) includes a helical portion 120A mounted around a boss of the release sector 110 and centered on the pivot pin 112. An arm 121 engages an abutment 122, which is secured to the latch chassis 12. The second arm 123 engages the abutment 118 of the release sector 110, thereby biasing the release sector 110 in a counter-clockwise direction about the pivot pin 112.

A motor sector 130 (see FIG. 1) is rotatable about the pivot pin 112 and includes an array of gear teeth 132. The motor sector 130 includes an arcuate slot 134, an abutment 136 and an abutment 138.

The release sector 110 includes a pin (not shown) which projects into the arcuate slot 134 of the motor sector 130. As shown in FIG. 1, the drive pin engages the unshown arcuate end of the arcuate slot 134. It will also be appreciated from FIG. 1 that the drive pin is spaced from an end 134A of the arcuate slot 134, thereby providing some lost motion, as will be described below.

A motor 140 (see FIG. 2) is mounted on the latch chassis 12 and drives a motor pinion 142 (see FIG. 1). The teeth of the motor pinion 142 engage the array of gear teeth 132.

Operation of the latch is as follows.

As shown in FIGS. 1 and 2, the latch 10 is in the closed position with the pawl release lever 30 being held in position by the secondary pawl 32. Neither the inside door handle 38 nor the outside door handle 48 have been actuated, and hence the handles 38 and 48 and the associated inside release lever 34 and the outside release lever 44 are in a rest position.

The arm 87 of the torsion spring 86 is engaged with the abutment 62 of the release shuttle 54 and hence has biased the release shuttle 54 generally upwardly when viewing FIG. 1.

The lock shuttle 90 is also in a raised position when viewing FIG. 1, and the abutment 93 is proximate the edge 43 of the inside release lever 34. Furthermore, the abutment 96 of the lock shuttle 90 is positioned to the left (when viewing FIG. 1) of the ledge 76 of the interlock lever 71, thereby preventing the interlock lever 71 from rotating clockwise under the influence of the torsion spring 86.

Note that the abutment 80A of the magnet 80 is spaced from the ledge 76 of the lock link 66. Additionally, no current is flowing through the coil of the electromagnet 85 i.e., the electromagnet 85 is not powered.

As shown in FIG. 1, the latch 10 is in a locked condition, i.e., operation of the outside door handle 48 will not unlatch the latch 10. Thus, when the outside door handle 48 is actuated, the outside release lever 44 rotates clockwise such that the abutment 52 of the outside release lever 44 engages and pushes the abutment 61 of the release shuttle 54. This causes the release shuttle 54 to move generally downwardly, which in turn causes the lock link 66 to also move generally downwardly. Because, as mentioned above, the interlock lever 71 is held in the position shown in FIG. 1, the right hand end of the interlock link 82 pivots around the pin 78, and the pin 83 therefore describes an arc centered on the position of the pin 78, as shown in FIG. 1. The interlock link 82 therefore guides the lower end of the lock link 66, and in particular guides the abutment 68. In particular, the interlock link 82 guides the abutment 68 such that it misses (bypasses) the abutment 116 of the release sector 110. As such, the release sector 110 does not move, and the latch 10 remains latched. The only major components to move when the outside release lever 44 is operated are the release shuttle 54, the lock link 66, the interlock link 82 and the arm 87 of the torsion spring 86. The interlock lever 71, the lock shuttle 90, the release sector 110, the motor sector 130 and the pawl release lever 30 all remain stationary.

Figure 7:
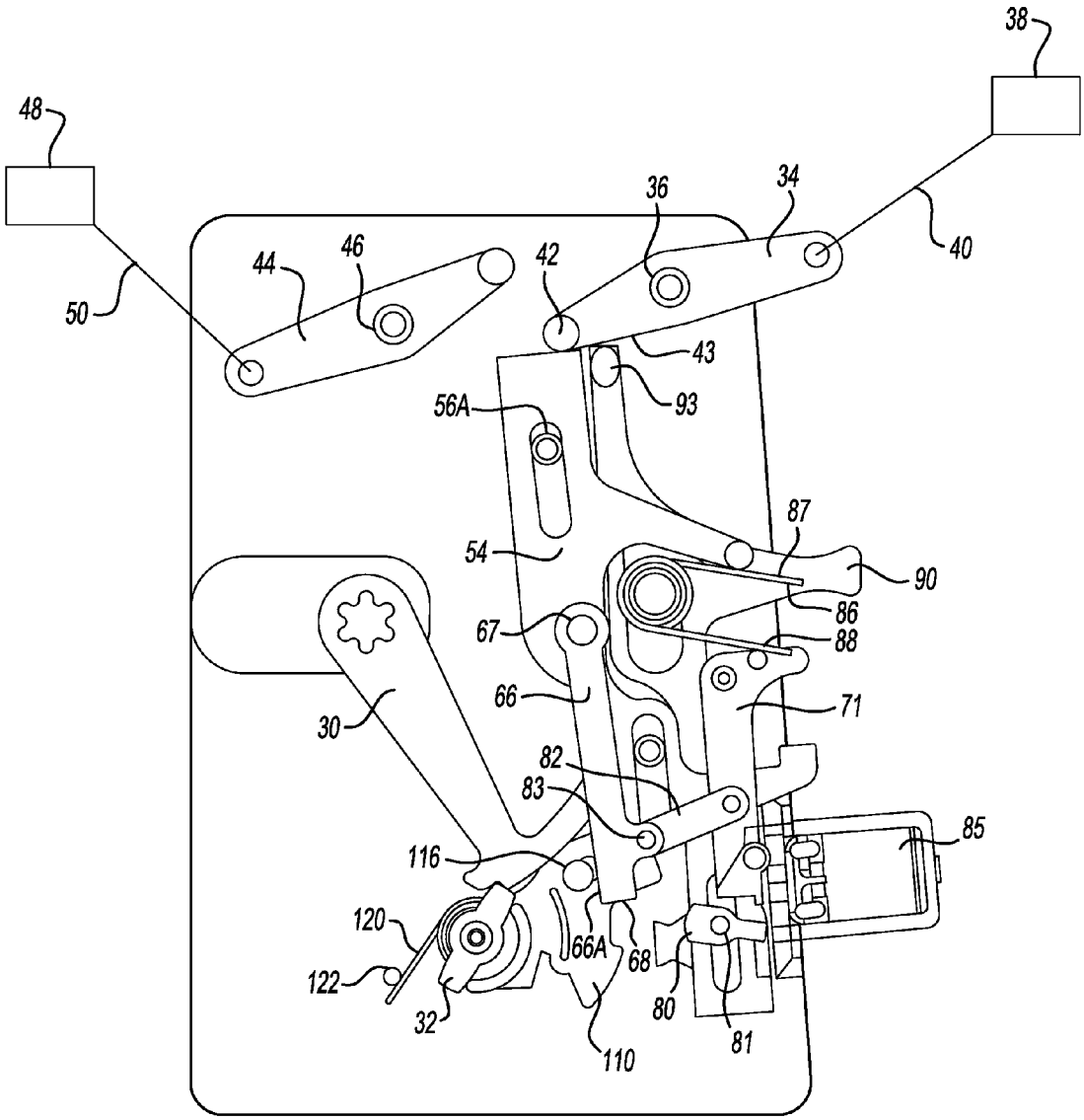

However, starting from the FIG. 1 position, while a first operation of the inside door handle 38 will also not unlatch the latch 10, a second operation of the inside door handle 38 will unlatch the latch 10. Thus, FIG. 7 shows the position of the components once the inside door handle 38 has been actuated for a first time (note the motor sector 130 is not shown in FIG. 7 for clarity). The inside release lever 34 has been rotated in a counter-clockwise direction, causing the abutment 42 to engage the abutment 60 of the release shuttle 54 and move it generally downwardly. The edge 43 has also engaged the abutment 93 of the lock shuttle 90, causing the lock shuttle 90 to move generally downwardly. This has resulted in the abutment 96 of the lock shuttle 90 disengaging from the ledge 76 of the interlock lever 71, allowing the interlock lever 71 to rotate clockwise about the pivot pin 73 under the influence of the bias of the torsion spring 86. However, the sequence of events is such that abutment 68 of the lock link 66 has moved past the abutment 116 of the release sector 110 before the abutment 96 disengages the ledge 76. Accordingly, an edge 66A of the lock link 66 rests on an adjacent edge of the abutment 116.

Figure 8:
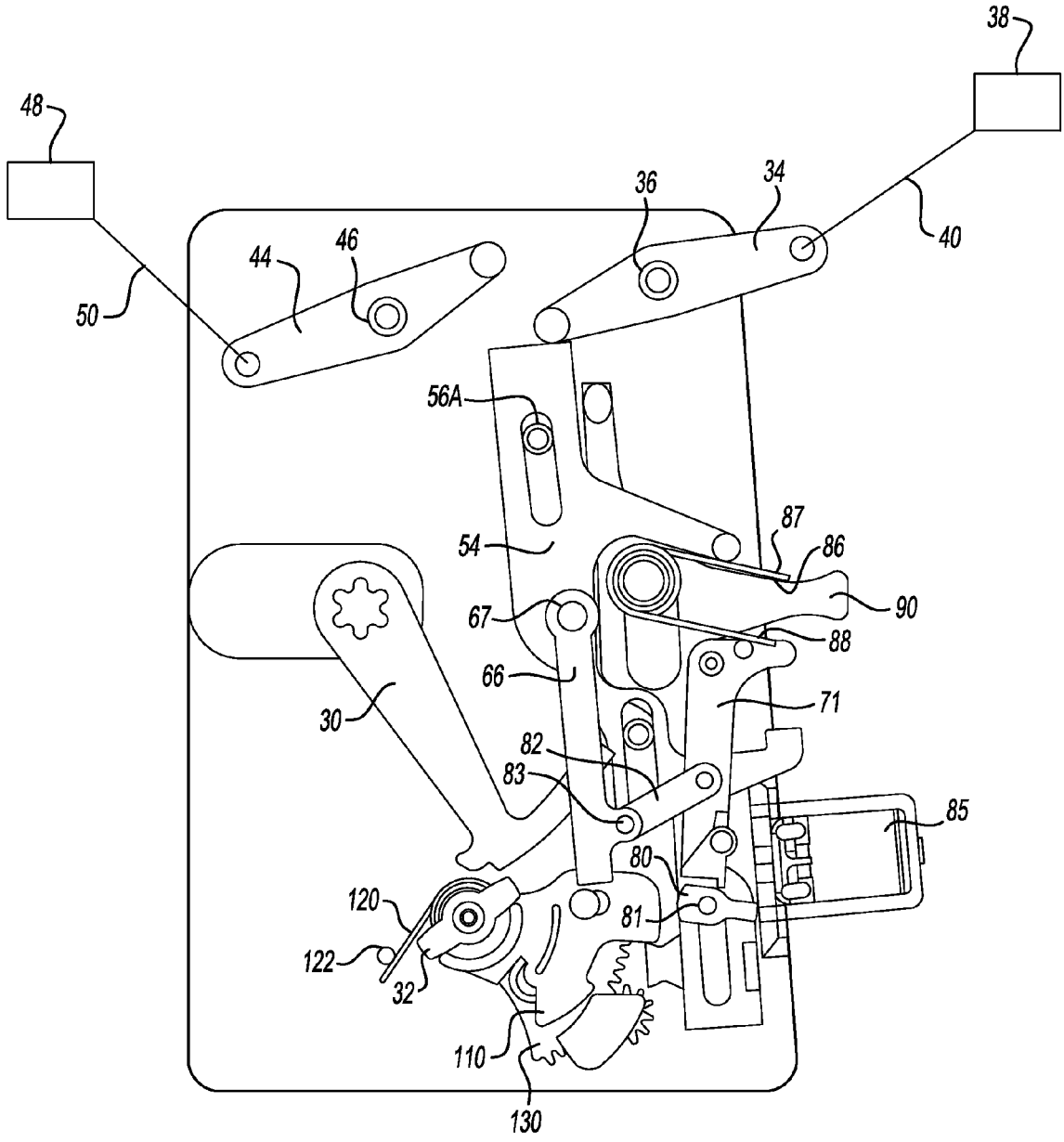

Once the inside door handle 138 is released, the inside release lever 34 returns to its rest position, as does the release shuttle 54 under the bias of the torsion spring 86. During this return movement, the edge 66A slides past the abutment 116 until such time as the abutment 68 passes the abutment 116, whereupon the arm 88 of the torsion spring 86 causes the interlock lever 71 to rotate clockwise about the pivot pin 73, thereby aligning the abutment 68 with the abutment 116. Note that during this return movement, the lock shuttle 90 remains in its lowered position, as shown in FIG. 7. A second actuation of the inside door handle 38 causes the inside release lever 34 to rotate counter-clockwise as shown in FIG. 8, thereby pushing the release shuttle 54 generally downwardly, which in turn pushes the lock link 66 generally downwardly such that the abutment 68 engages the abutment 116, thereby rotating the release sector 110 and the secondary pawl 32 in a clockwise direction and hence disengaging the secondary pawl 32 from the pawl release lever 30. This position is shown in FIG. 8, wherein the secondary pawl 32 has just been disengaged from the pawl release lever 30, but the pawl release lever 30 has not yet moved to a position such that the pawl 26 disengages from the claw 14. This latter movement occurs automatically.

To summarize, the interlock lever 71 can be held in the FIG. 1 position by the lock shuttle 90 to lock the latch 10. Under these circumstances, operation of the outside door handle 48 will not unlatch the latch 10.

A first operation of the inside door handle 38 will unlock the latch 10 (i.e., disengage the abutment 96 from the ledge 76), but will not unlatch the latch 10. A second operation of the inside door handle 38 will unlatch the latch 10. Note that after the first operation of the inside door handle 38, the latch 10 is unlocked and it will be appreciated that once unlocked, either a second operation of the inside door handle 38 or a first operation of the outside door handle 48 will open the latch 10.

The latch 10 can also be held in a locked position by the magnet 80 or by the electromagnet 85. Such operation is described in the Applicant's copending application EP01310100 and EP01310124, but in summary, FIG. 3 shows the position of various components of the latch 10 when the inside door handle 38 has been actuated, but when the electromagnet 85 is powered.

When the electromagnet 85 is powered, current flows around the coil of the electromagnet 85 in a first direction, and it creates a magnetic field which attracts the magnetic piece 77 of the interlock lever 71. The system is arranged such that the magnetic field causes the permanent magnet 80 to adopt the position shown in FIG. 1. The magnet 80 is arranged to have one magnetic pole at an abutment 80A and the other magnetic pole at an end 80B. The current flowing through the electromagnet 85 is arranged so that the magnetic field generated by that current causes the magnet 80 to adopt the position shown in FIG. 1.

Figure 3:
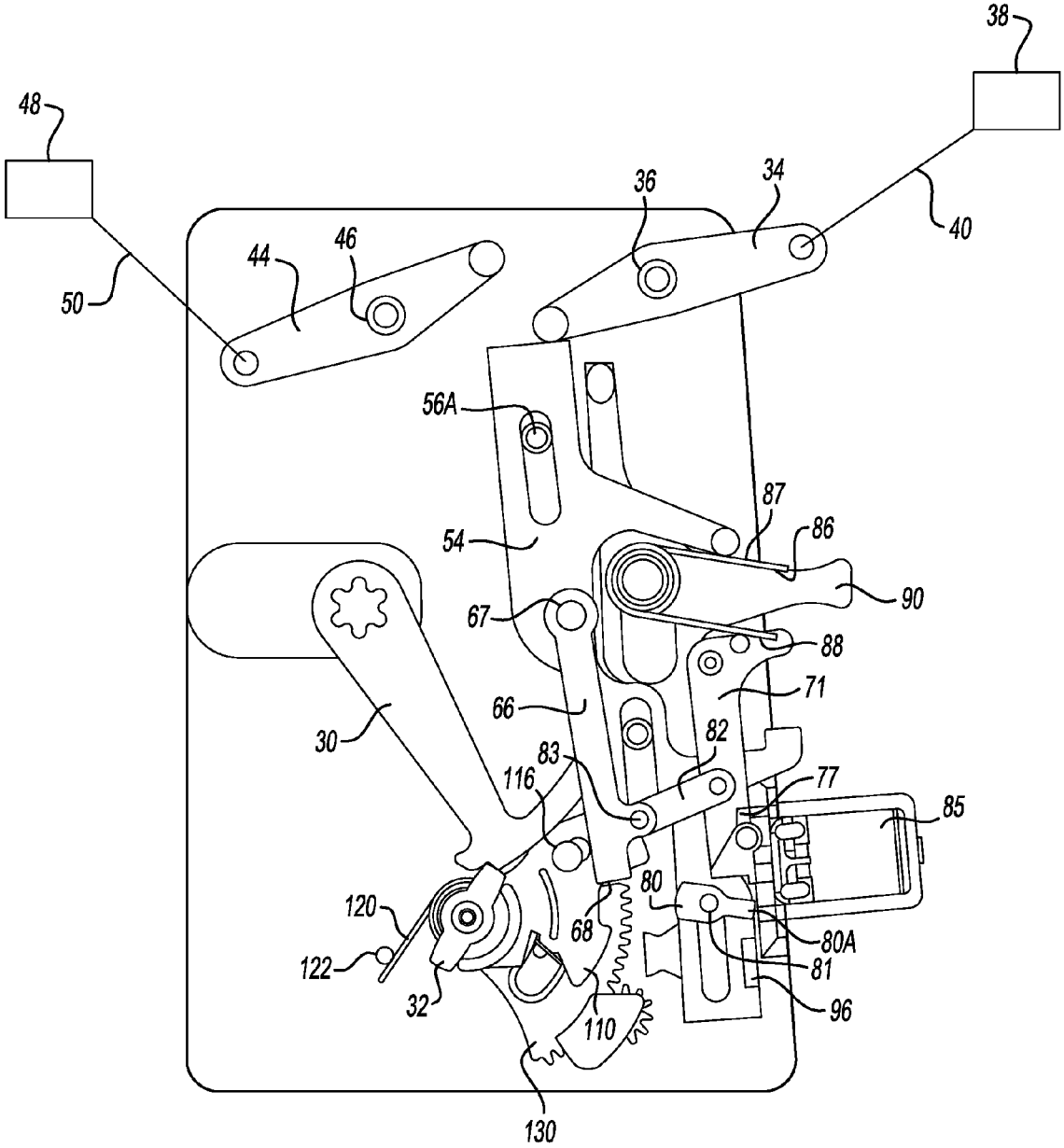
FIGS. 3 to 10 show the components of the latch system of FIG. 1 in various positions.

While the arm 88 of the torsion spring 86 tends to bias the interlock lever 71 in a clockwise direction about the pivot pin 73, the arrangement is such that the electromagnet 85 holds the interlock lever 71 in the position shown in FIG. 3. Because the interlock lever 71 is held in the FIG. 3 position, the abutment 68 of the lock link 66 bypasses the abutment 116 of the release sector 110, and the latch 10 does not open.

Note that the abutment 80A of the magnet 80 is spaced from the ledge 76, as is the abutment 96 of the lock shuttle 90.

Clearly, the magnet 80 and the lock shuttle 90 are not retaining the interlock lever 71 in place. This is being done solely by the electromagnet 85.

Figure 4:
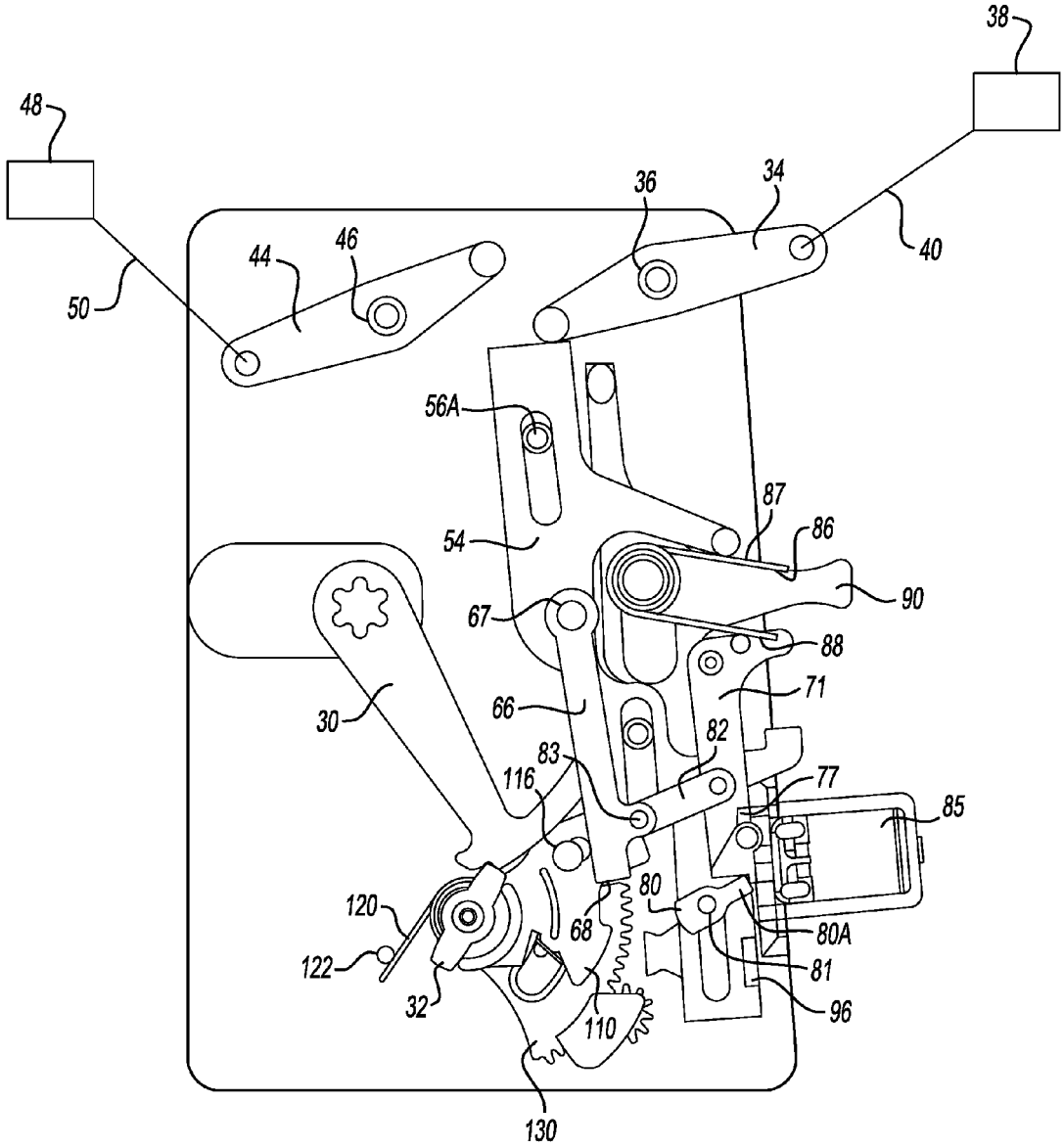

As mentioned above, the magnet 80 can also be used to retain the interlock lever 71 in place. As shown in FIG. 4, the magnet 80 has been rotated counter-clockwise when compared with FIG. 3, and the abutment 80A of the magnet 80 is positioned directly to the left of the ledge 76, thereby preventing the interlock lever 71 from rotating clockwise. The permanent magnet 80 can be brought to this position by applying a current pulse of appropriate polarity to the electromagnet 85 or by turning a key which is mechanically linked to the magnet 80 (the key and mechanical connections are not shown). Note no current is being supplied to the electromagnet 85 after it has been moved. The lock shuttle 90 is in the same position as shown in FIG. 3 and FIG. 4. As such, as shown in FIG. 4, the lock shuttle 90 and the electromagnet 85 have no effect on the interlock lever 71, which is being held in position solely by the magnet 80, and in particular the abutment 80A engaging the ledge 76. As shown in FIG. 4, it can be seen that the abutment 68 has bypassed the abutment 116 when the inside door handle 38 was actuated, thereby leaving the latch 10 in a latched condition.

The motor 140 is capable of both unlatching the latch 10 and locking the latch 10 as follows.

FIG. 1 shows the lock shuttle 90 in a raised position such that the abutment 96 is engaged with the ledge 76. FIGS. 3, 4, 7 and 8 show the lock shuttle 90 in a lowered position such that the abutment 96 is spaced downwardly from the ledge 76. As described above, with the lock shuttle 90 in the raised position, operation of the inside door handle 38 causes the lock shuttle 90 to move to the lowered position. However, the lock shuttle 90 can be returned to the raised (locked) position by actuation of the motor 140. Thus, powering the motor 140 such that the gear teeth 132 is rotated in a clockwise direction when viewing FIG. 1 causes the motor sector 130 to rotate in a counter-clockwise direction about the pivot pin 112. This will cause the abutment 136 of the motor sector 130 to engage the abutment 95 of the lock shuttle 90 and then move the lock shuttle 90 generally upwardly when viewing FIG. 1. Note that when this occurs, because the end 134A of the arcuate slot 134 is spaced from the pin of the release sector 110 that sits in the arcuate slot 134, the release sector 110 is not required to rotate counter-clockwise due to this lost motion connection.

Figure 5:
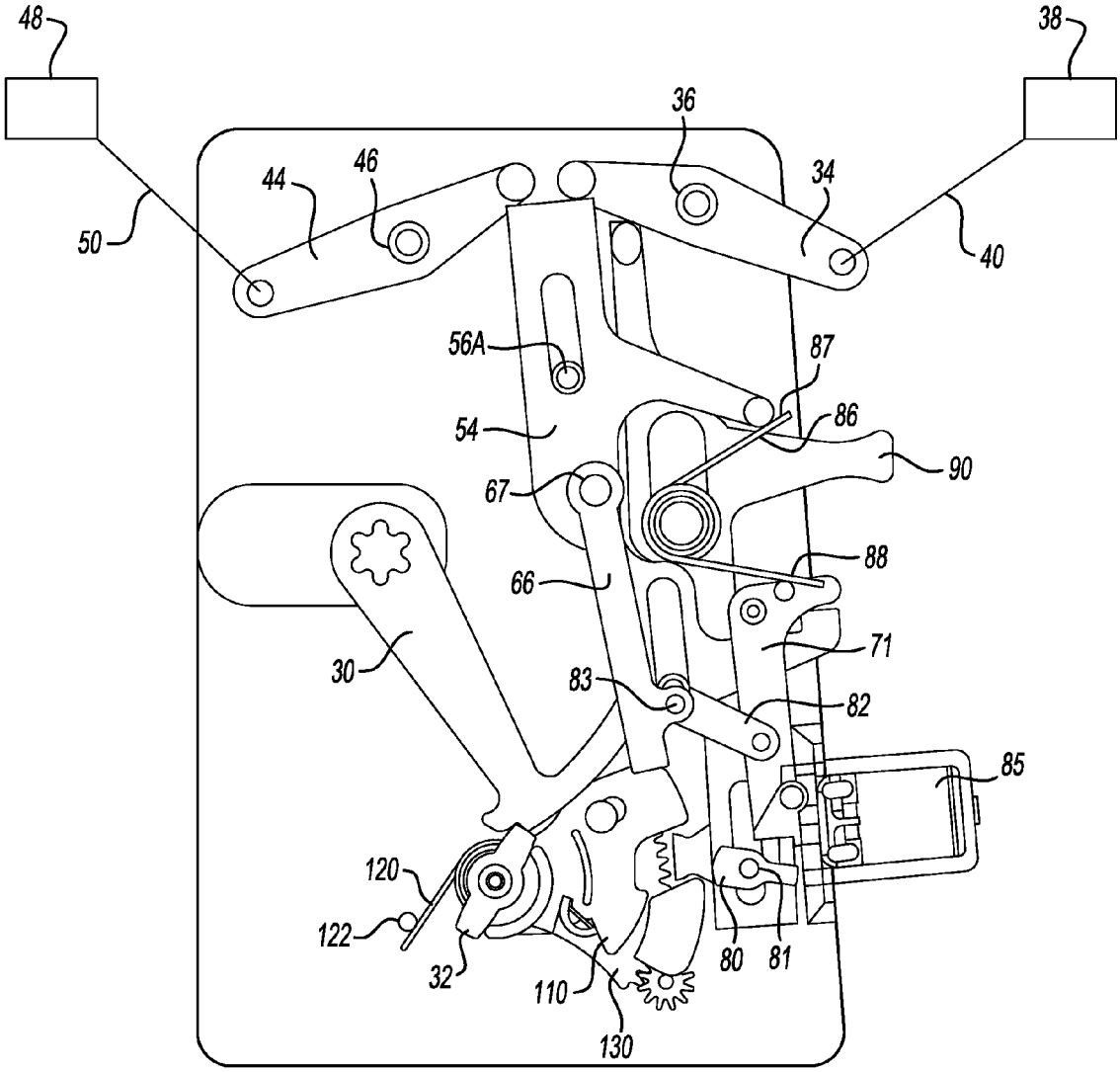
Figure 6:
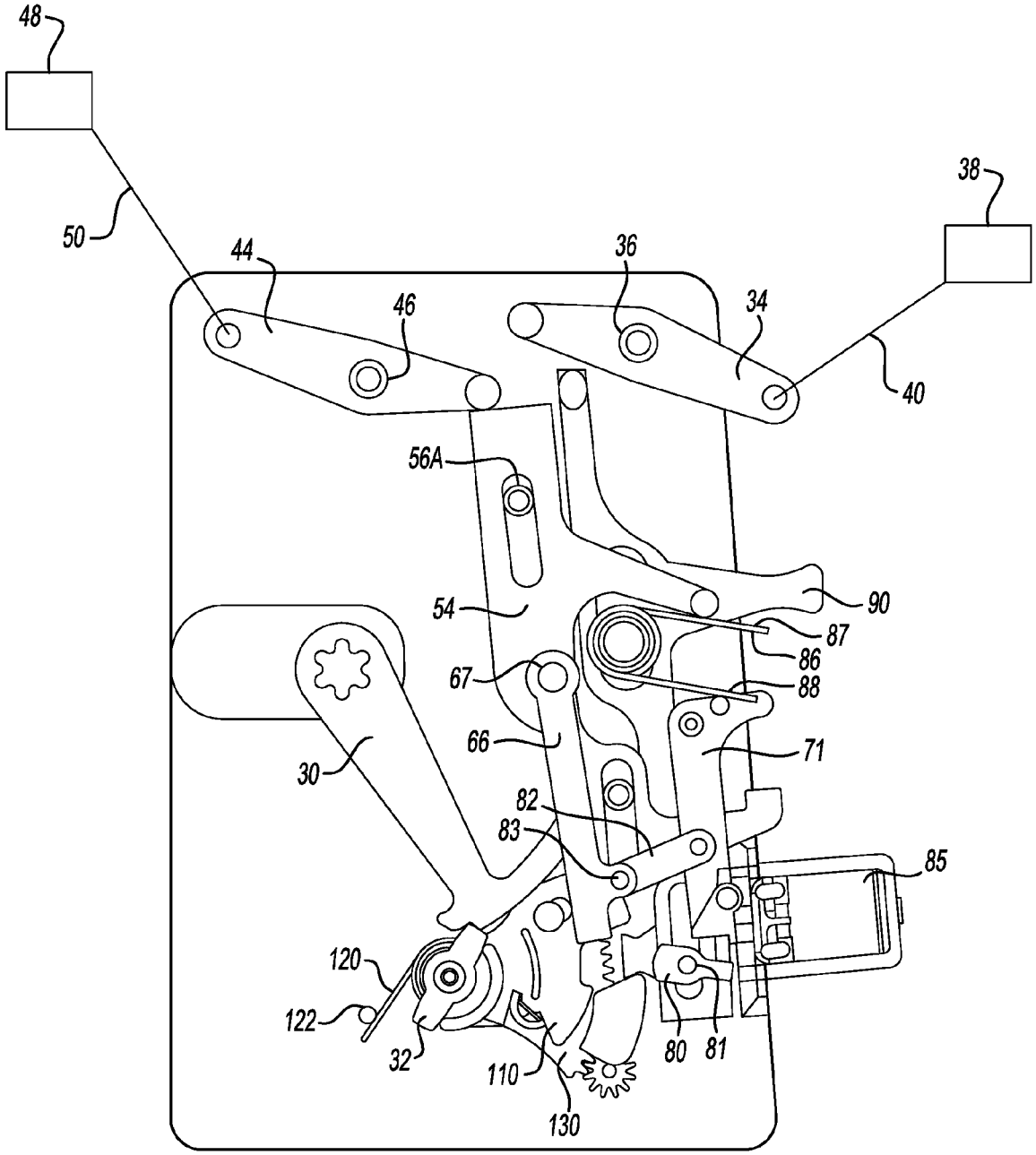

FIG. 5 shows the motor 140 having driven the lock shuttle 90 generally upwardly to the locked position. Once in this position, the door is locked, and FIG. 6 shows an actuation of the outside door handle 48 that does not result in the latch 10 opening (see previous description for full explanation).

Starting from the FIG. 1 position, in order for the motor 140 to release the latch 10, it is powered in a direction such that the motor pinion 142 rotates in a counter-clockwise direction, thereby causing the motor sector 130 to rotate in a clockwise direction about the pivot pin 112. Because the pin of the release sector 110 that sits within the slot 134 is adjacent the end of the arcuate slot 134 opposite the end 134A, as soon as the motor sector 130 starts to move in a clockwise direction when viewing FIG. 1, the end of arcuate slot 134 engages the pin of the release sector 110, causing the release sector 110 itself to move in a clockwise direction, thereby disengaging the secondary pawl 32 from the pawl release lever 30, allowing the latch 10 to open.

Figure 9:
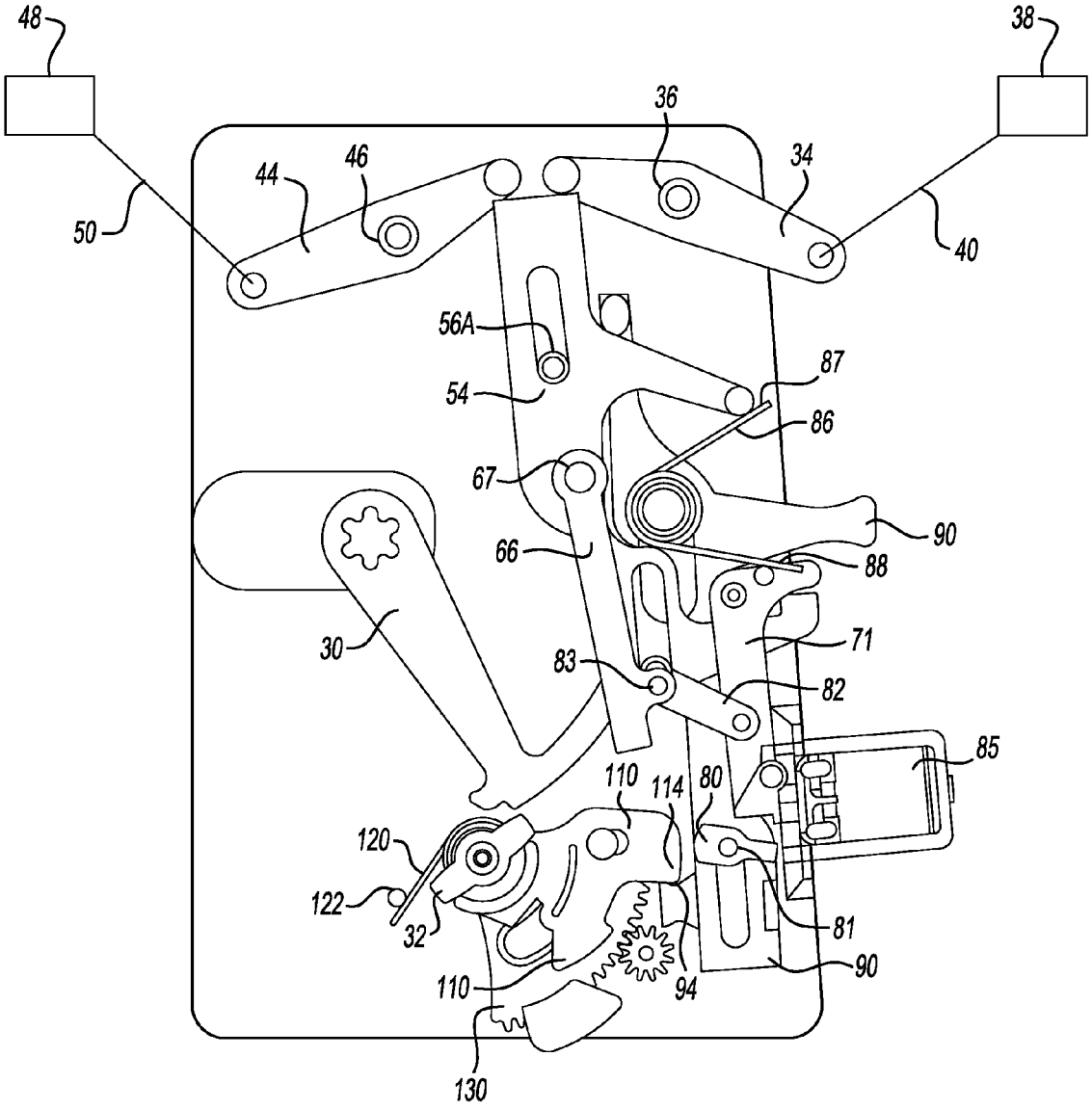
Figure 10:
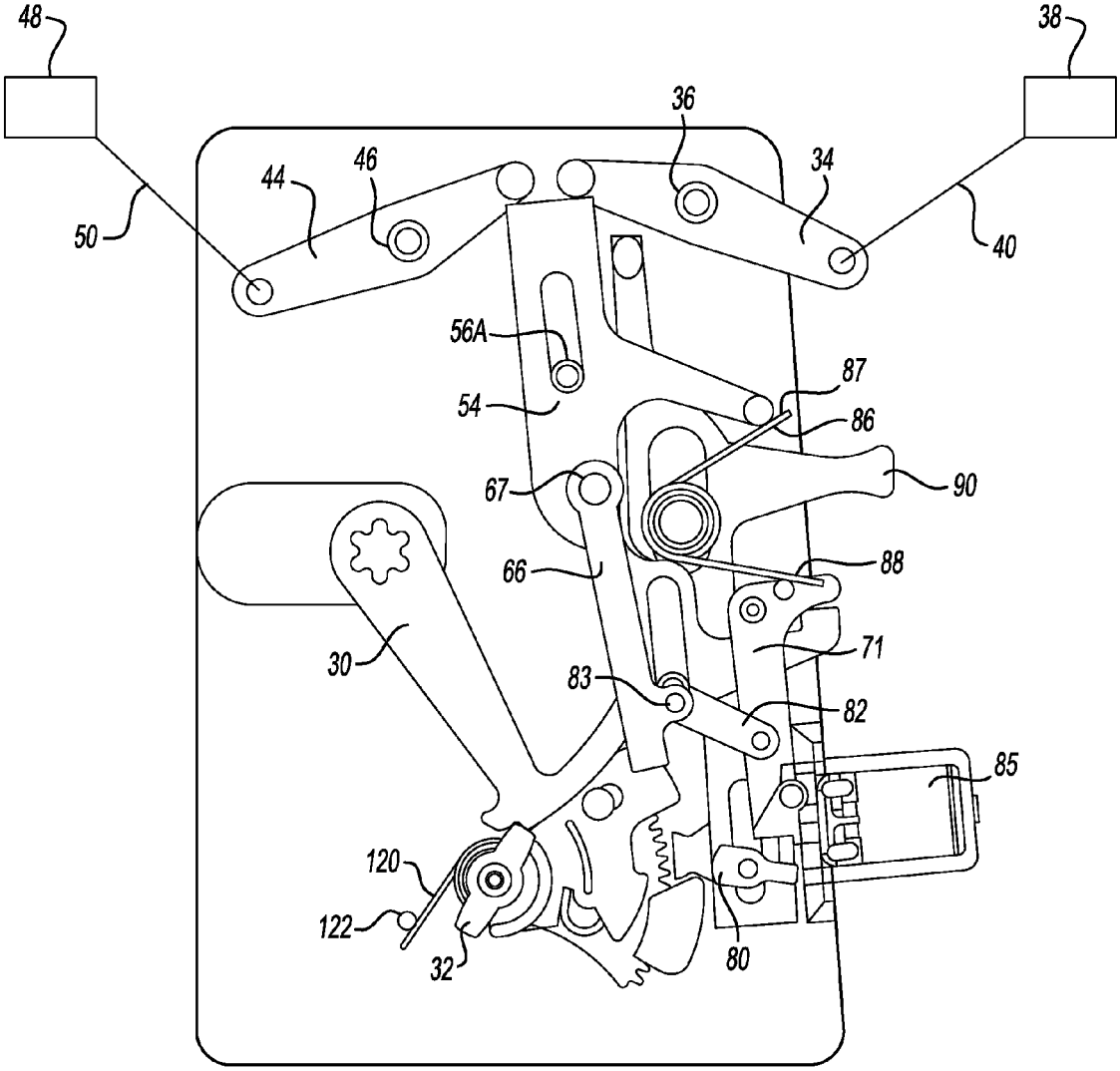

FIG. 9 shows the latch 10 having been power unlatched by the motor 140. In particular, the abutment 114 of the release sector 110 has engaged the abutment 94 of the lock shuttle 90, causing the lock shuttle 90 to move generally downwardly, thereby unlocking the latch 10 i.e., the motor 140 simultaneously unlatches the latch 10 and moves the lock shuttle 90 to the lowered position.

FIGS. 16 to 19 show enlarged views of certain components of the latch 10 system, and in particular show operation of the torsion spring 86.

Figure 16:
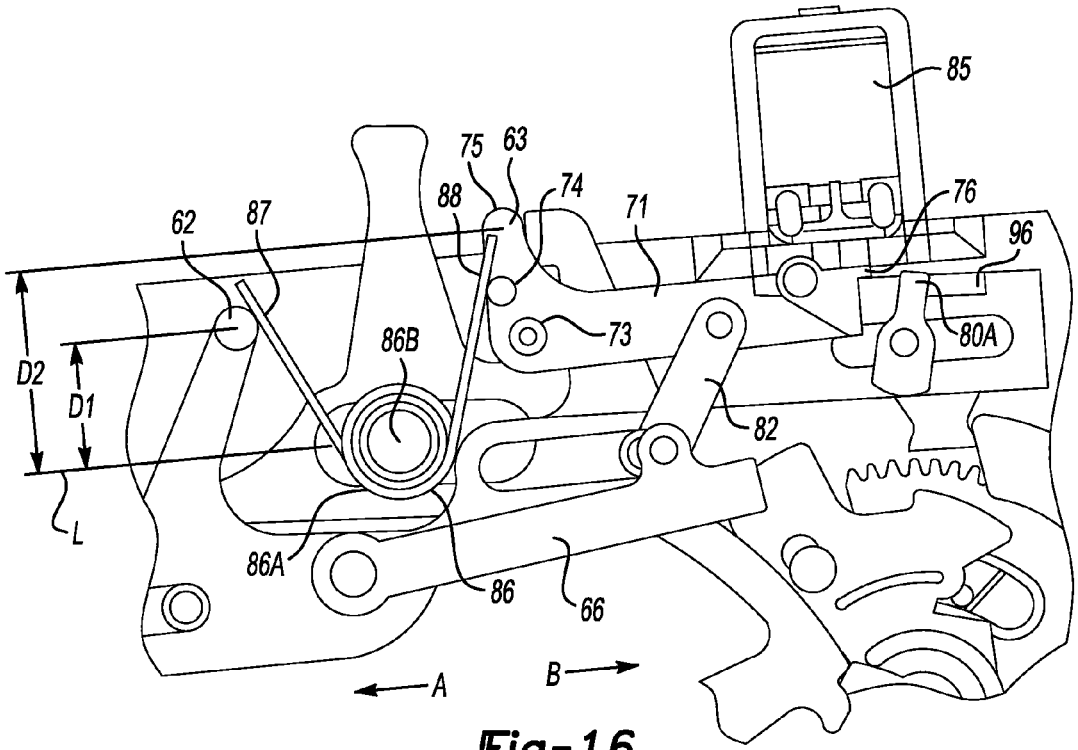
FIGS. 16 to 19 show an enlarged view of certain components of the latch system of FIG. 1.

FIG. 16 shows the abutment 80A of the permanent magnet 80 spaced from the ledge 76. Furthermore, the abutment 96 of the lock shuttle 90 is also spaced from the ledge 76. Finally, no current is passing through the coils of the electromagnet 85. Nevertheless, the interlock lever 71 is being biased to the counter-clockwise position shown in FIG. 16 by the torsion spring 86.

Thus, the arm 87 of the torsion spring 86 acts upon abutment 62 of the release shuttle 54, and this biasing action tends to move the release shuttle 54 in the direction of arrow A, i.e., to the left when viewing FIG. 16.

The arm 88 of torsion spring 86 acts on the abutment 74 of the interlock lever 71. This biasing action acts so as to bias the interlock lever 71 in a clockwise direction. However, the interlock lever 71 remains in the position shown in FIG. 16 because the abutment 75 of the interlock lever 71 is engaged with the abutment 63 of the release shuttle 54. Thus, the bias of the arm 88 ultimately acts on the abutment 63, tending to bias the release shuttle 54 in the direction of arrow B, i.e., to the right when viewing FIG. 16.

A line L (see FIG. 16) passes through the center point 86B of the helical portion 86A of the torsion spring 86. The line L extends in a direction parallel to the direction of movement of release shuttle 54 (i.e., parallel to the slots 56 and 58). It can be seen from FIG. 16 that the abutment 62 of the release shuttle 54 is spaced at a distance D1 from the line L, whereas the abutment 63 of the release shuttle 54 is spaced at a distance D2 from the line L, the distance D2 being larger than the distance D1 (see also FIG. 11).

Because the torsion spring 86 is a torsion spring, then the torque generated by the arm 87 (tending to bias the release shuttle 54 in the direction of an arrow A) is the same as the torque generated by the arm 88 (tending to bias the release shuttle in the direction of an arrow B). Because the torques generated by the arms 87 and 88 are the same, but the distance D1 is smaller than the distance D2, the force on the abutment 62 is greater than the force on the abutment 63, and hence the torsion spring 86 biases the release shuttle 54 to the leftmost position as shown in FIG. 16. This in turn causes the interlock lever 71 to be biased to the counter-clockwise most position as shown in FIG. 16.

As mentioned above, and as shown in FIG. 16, the electromagnet 85, the permanent magnet 80, and the lock shuttle 90 do not retrain movement of the interlock lever 71. Starting from the FIG. 16 position, when either the inside door handle 38 or the outside door handle 48 are operated, the release shuttle 54 is initially moved to the position shown in FIG. 17. Significantly, movement of the release shuttle 54 to the FIG. 17 position causes the abutment 63 to move generally to the right, thereby allowing the interlock lever 71 to rotate clockwise under the influence of the bias generated by the arm 88 of the torsion spring 86. This initial movement causes the abutment 68 of the lock link 66 to move generally downwardly and become aligned with the abutment 116 of the release sector 110.

Figure 17:
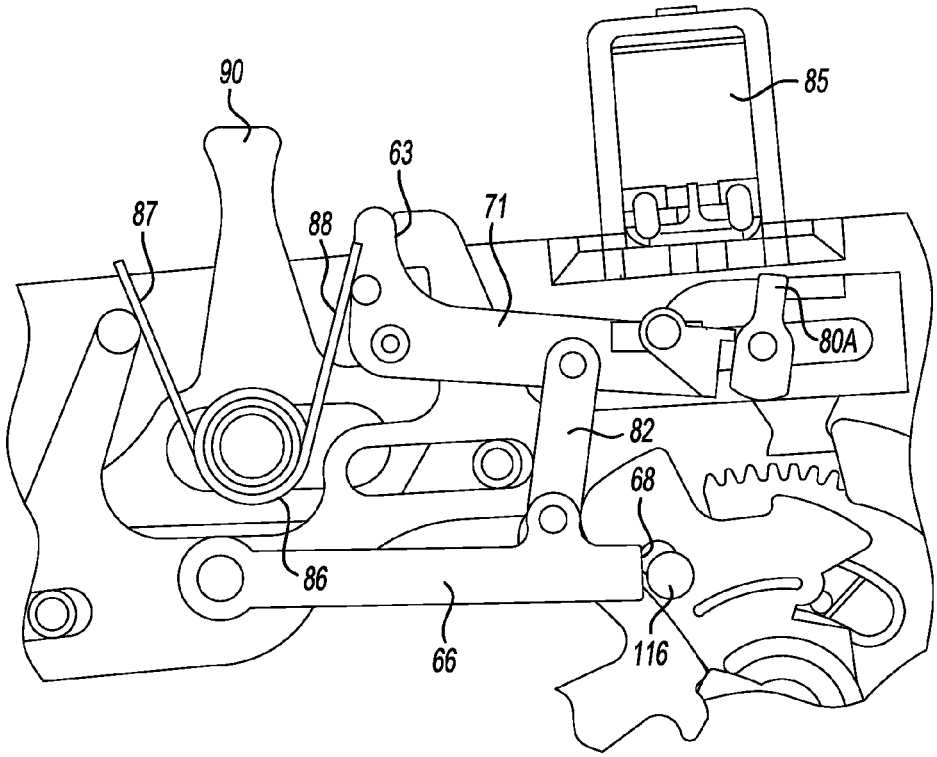
Figure 18:
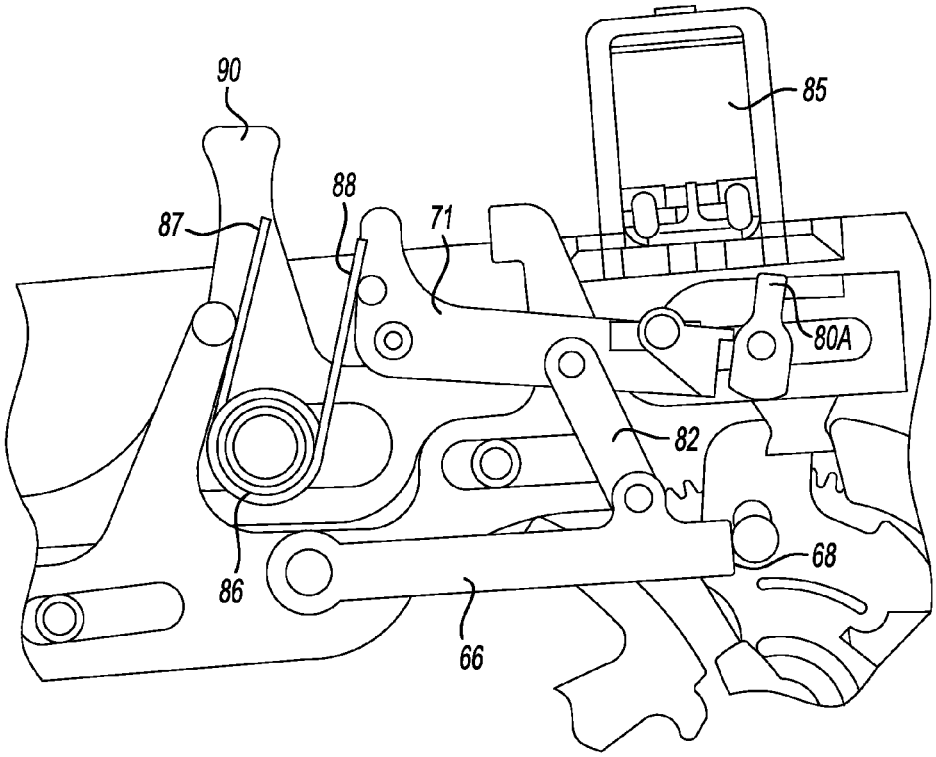

Continued operation of the inside door handle 38 or the outside door handle 48 causes the release shuttle 54 to continue to move to the right to the position shown in FIG. 18 whereby the abutment 68 has caused the release sector 110 to rotate clockwise, thereby releasing the latch 10. Note that the position of interlock lever 71 remains unchanged when comparing FIGS. 17 and 18, as does the position of the lock shuttle 90.

A comparison of FIGS. 16, 17 and 18 show the pivotal movement of the interlock link 82 and how it guides the right hand end of the lock link 66, in particular the abutment 68.

Figure 19:
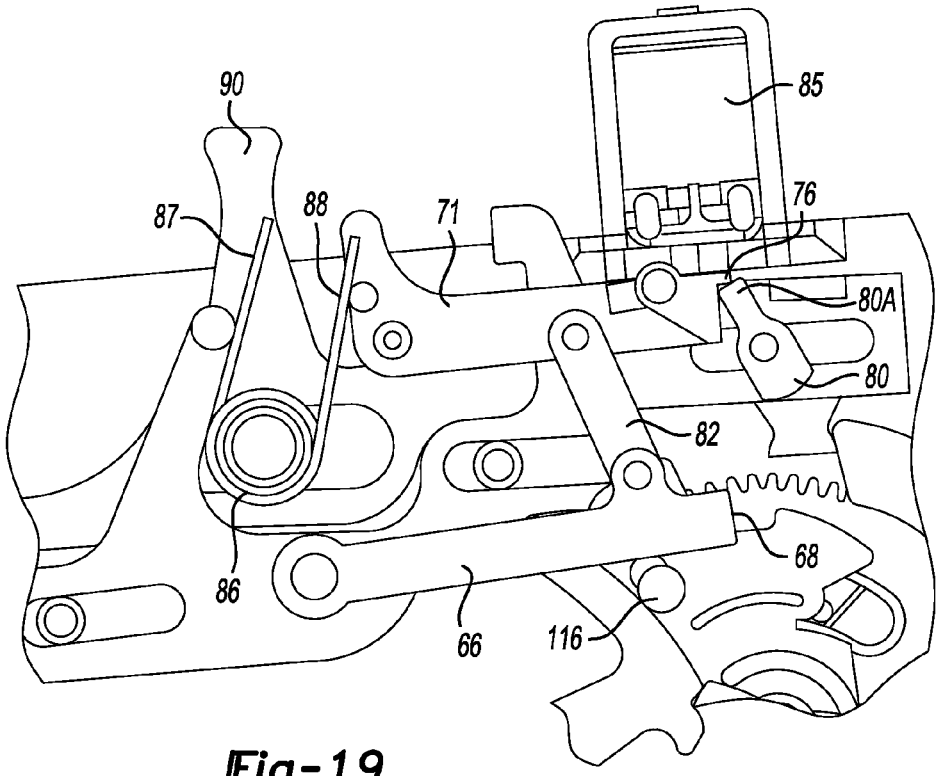
Figure 20:
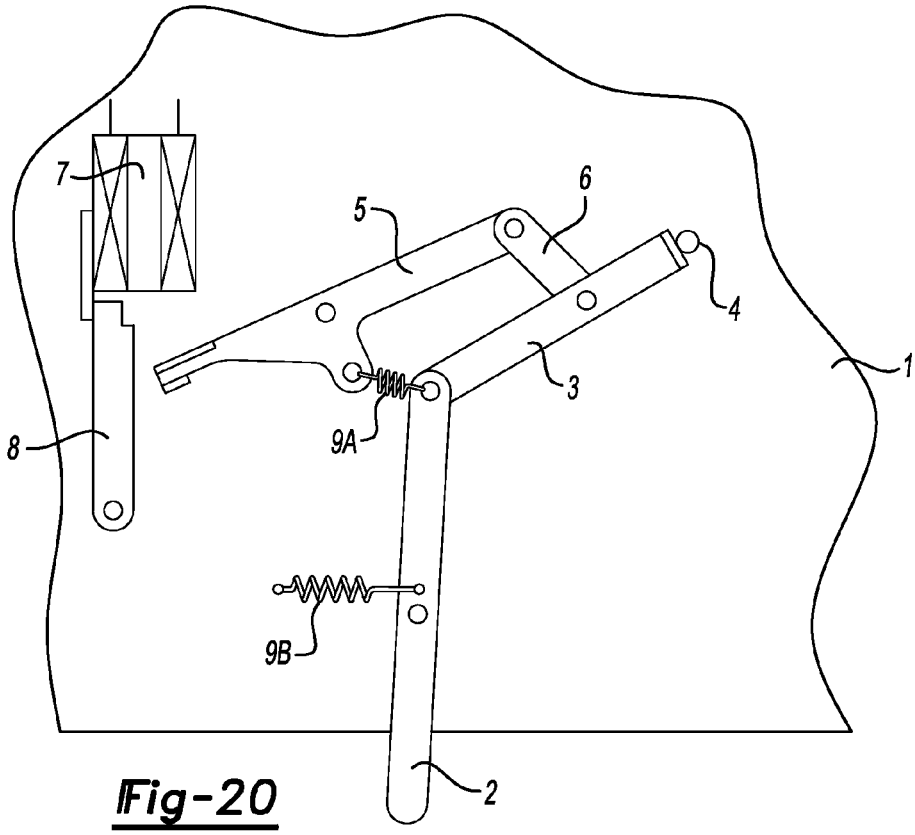
Fig-20 PRIOR ART
FIG. 20 shows a prior art latch.

FIG. 19 shows the permanent magnet 80 having being rotated in a counter-clockwise direction when compared to FIG. 16 such that the abutment 80A engages the ledge 76. As such, when the inside door handle 38 or the outside door handle 48 has been actuated, the interlock lever 71 has remained in the same position, and the interlock link 82 has guided the abutment 68 of the lock link 66 past the abutment 116, i.e., the interlock link 82 has caused the abutment 68 to bypass the abutment 116.

It will be appreciated from the above description of the latch system and its operation that a transmission path exists between the inside door handle 38 and the pawl 26. The transmission path (also known as a first transmission path) includes the connection 40, the inside release lever 34 (also known as an inside release member), the release shuttle 54, the lock link 66, the release sector 110, the secondary pawl 32, and the pawl release lever 30.

Another transmission path (also known as a second transmission path) exists between the outside door handle 48 and the pawl 26. This transmission path includes the connection 50, the outside release lever 44 (also known as a second release member), the release shuttle 54, the lock link 66, the release sector 110, the secondary pawl 32, and the pawl release lever 30.

Certain components of the above mentioned first transmission path and the second transmission path are common to both transmission paths, most significantly the release shuttle 54 and the lock link 66, i.e., the release shuttle 54 and the lock link 66 at least are a common portion of the transmission paths.

The lock link 66 acts to either complete the transmission path between the inside door handle 38 or the outside door handle 48 and the pawl 26 or it acts to break that transmission path. When the lock link 66 is in the position shown in FIGS. 8 and 17, the lock link 66 completes the transmission path since subsequent movement of the release shuttle 54 will cause the abutment 68 to move the abutment 116, thereby releasing the latch 10. However, when the lock link 66 is in the position shown in FIGS. 3-6, 10 or 19, the lock link 66 is in a condition where it clearly has not completed the transmission path, since in all these circumstances the latch 10 will not be opened.

The latch system has three distinct ways of retaining the lock link 66 in a condition where it will not complete the transmission path, namely the electromagnet 85, the permanent magnet 80, and the lock shuttle 90. The electromagnet 85, the permanent magnet 80 and the lock shuttle 90 therefore provide three separate ways of holding the lock link 66 in a condition where the common portion of the transmission path is broken.

As mentioned above, the slots 56 and 58 are generally parallel to each other, and this ensures that the release shuttle 54 moves in a linear manner. Alternatively, the slots 56 and 58 could be arcuate in form with both arcs being centered about the same point. Such an arrangement would cause the release shuttle 54 to rotate as it moves. In further embodiments, the slots 56 and 58 could be straight but not parallel to each other, or they could be arcuate with each arc being centered on a different point, or one or other or both slots could be sinuous in nature. Under these circumstances, the release shuttle 54 would move in a manner that was both rotational and translational.

The above mentioned forms of slot described for the release shuttle 54 are equally applicable to the lock shuttle 90.

As mentioned above, the interlock link 82 guides (or controls) the position of abutment 68. Accordingly, the interlock link 82 is also referred to as a (first) control member. The interlock lever 71 controls the position of the hole 84 of the interlock link 82, and accordingly the interlock lever 71 is referred to as a (second) control member.

In this case, the electromagnet 85, the permanent magnet 80, and the release shuttle 54 all act on the interlock lever 71, though in further embodiments this need not be the case.

The primary pawl 26 of the present invention (i.e., the pawl 26 that engages the claw 14) is mounted on its eccentric arrangement 28, details of which can be found in the international patent application PCT/GB2006/000586. However, in further embodiments, the pawl 26 could be mounted in a more conventional manner directly onto a pivot pin, i.e., mounted in such a manner that during opening and closing the pawl 26 purely rotates about a single, fixed axis (in this example the fixed axis of the pawl pin).

The foregoing description is only exemplary of the principles of the invention. Many modifications and variations are possible in light of the above teachings. It is, therefore, to be understood that within the scope of the appended claims, the invention may be practiced otherwise than using the example embodiments which have been specifically described. For that reason the following claims should be studied to determine the true scope and content of this invention.

What is claimed is:

1. A latch system comprising:

a latch bolt;

a pawl for releasably retaining the latch bolt in a closed position;

a first release member;

a first transmission path connecting the first release member to the pawl;

a second release member;

a second transmission path connecting the second release member to the pawl, wherein a portion of the first transmission path and a portion of the second transmission path have a common portion, the common portion including a lock link having a first position at which the lock link completes the first transmission path and the second transmission path such that operation of either the first release member or the second release member opens a latch, and the lock link having a second position at which the lock link breaks the first transmission path and the second transmission path such that a single operation of either the first release member or the second release member does not open the latch;

a first device capable of holding the lock link in the second position;

a second device capable of holding the lock link in the second position; and a third device capable of holding the lock link in the second position, wherein the single operation of the first release member moves the lock link into the first position without opening the latch such that a second operation of the first release member after the single operation of the first release member opens the latch.

2. The latch system as defined in claim 1 wherein the lock link is operably connected to a magnetic component, and the first device is an electromagnet operable to hold the magnetic component in a position such that the lock link is held in the second position.

3. The latch system as defined in claim 2 wherein the second device includes a permanent magnet moveable to a position by changing a magnetic field of the first device so that the lock link is held in the second position.

4. The latch system as defined in claim 3 wherein the magnetic field local to the permanent magnet is generated by the electromagnet.

5. The latch system as defined in claim 1 wherein the third device includes an abutment moveable to a position such that the lock link is held in the second position.

6. The latch system as defined in claim 5 wherein the third device moves generally linearly.

7. The latch system as defined in claim 5 wherein the third device moves generally rotationally.

8. The latch system as defined in claim 5 wherein the third device both translates and rotates.

9. The latch system as defined in claim 1 wherein operation of the first release member causes the third device to free the lock link for movement to the first position.

10. The latch system as defined in claim 1 wherein the third device is manually moveable to a position at which the third device retains the lock link in the second position.

11. The latch system as defined in claim 1 including a motor operable to unlatch the latch.

12. The latch system as defined in claim 11 wherein, during power opening of the latch, the motor causes the third device to free the lock link before movement to the first position.

13. The latch system as defined in claim 11 wherein the motor is capable of moving the third device to a position such that the lock link is retained in the second position.

14. The latch system as defined in claim 1 wherein the lock link is moveable between the first position and the second position by a first control member.

15. The latch system as defined in claim 14 wherein the first control member is moveable by a second control member.

16. The latch system as defined in claim 15 wherein at least one of the first device, the second device and the third device act on the second control member to retain the lock link in the second position.

17. A latch system comprising:

a latch bolt;

a pawl for releasably retaining the latch bolt in a closed position;

a first release member;

a first transmission path connecting the first release member to the pawl;

a second release member;

a second transmission path connecting the second release member to the pawl, wherein a portion of the first transmission path and a portion of the second transmission path have a common portion, the common portion including a lock link having a first position at which the lock link completes the first transmission path and the second transmission path such that operation of either the first release member or the second release member opens a latch, and the lock link having a second position at which the lock link breaks the first transmission path and the second transmission path such that a single operation of either the first release member or the second release member does not open the latch and wherein the single operation of the first release member moves the lock link into the first position without opening the latch such that a second operation of the first release member after the single operation of the first release member opens the latch;

a device capable of holding the lock link in the second position, wherein the lock link is moveable between the first position and the second position by a first control member, the first control member is moveable by a second control member, and the device acts on the second control member to hold the lock link in the second position; and a resilient device that acts to bias the lock link to the first position.

18. A latch system comprising:

a latch bolt;

a pawl for releasably retaining the latch bolt in a closed position;

a first release member;

a first transmission path connecting the first release member to the pawl;

a second release member;

a second transmission path connecting the second release member to the pawl;

a portion of the first transmission path and a portion of the second transmission path have a common portion, the common portion including a lock link having a first position at which the lock link completes the first transmission path and the second transmission path such that operation of either the first release member or the second release member opens a latch, and the lock link having a second position at which the lock link breaks the first transmission path and the second transmission path such that a single operation of either the first release member or the second release member does not open the latch; a device capable of holding the lock link in the second position and wherein the single operation of the first release member moves the lock link into the first position without opening the latch such that a second operation of the first release member after the single operation of the first release member opens the latch; and a motor operable to unlatch the latch, wherein during power opening of the latch, the motor causes the device to free the lock link for movement to the first position, and the motor is capable of moving the device to a position such that the lock link is retained in the second position.

* * * * *